US011512261B2

(12) United States Patent
Redmann et al.

(10) Patent No.: US 11,512,261 B2
(45) Date of Patent: Nov. 29, 2022

(54) DIESEL FUEL WITH IMPROVED IGNITION CHARACTERISTICS

(71) Applicant: SHELL OIL COMPANY, Houston, TX (US)

(72) Inventors: Jan-Hendrik Redmann, Hamburg (DE); Andrea Schuetze, Hamburg (DE); Werner Pauer, Hamburg (DE); Hans Moritz, Hamburg (DE); Thomas Hellwig, Wedel (DE)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/048,067

(22) PCT Filed: Apr. 5, 2019

(86) PCT No.: PCT/EP2019/058704
§ 371 (c)(1),
(2) Date: Oct. 15, 2020

(87) PCT Pub. No.: WO2019/201630
PCT Pub. Date: Oct. 24, 2019

(65) Prior Publication Data

US 2021/0139799 A1 May 13, 2021

(30) Foreign Application Priority Data

Apr. 20, 2018 (EP) ..... 18168402

(51) Int. Cl.
*C10L 1/19* (2006.01)
*C10L 10/12* (2006.01)

(52) U.S. Cl.
CPC ..... *C10L 1/19* (2013.01); *C10L 1/1905* (2013.01); *C10L 10/12* (2013.01); *C10L 2200/0446* (2013.01); *C10L 2270/026* (2013.01)

(58) Field of Classification Search
CPC ..... C10L 1/19; C10L 1/1905; C10L 10/12; C10L 2200/0446; C10L 2270/026; C10L 1/226
See application file for complete search history.

(56) References Cited

U.S. PATENT DOCUMENTS 2,225,879 A 12/1940 Pharis et al.
2,877,102 A 3/1959 Levesque et al.
(Continued)

FOREIGN PATENT DOCUMENTS

BR PI1100483 A2 * 5/2013
BR PI1100483 A2 * 5/2013
(Continued)

OTHER PUBLICATIONS

Experimental determination of fuel evaporation rates using IR Thermography M Founti D Kolaitis G Zannis O Kastner D Trimis 018 (psu.edu) International Conference QIRT 2002 Dubrovnik Sep. 2002 (Year: 2002).*
(Continued)

*Primary Examiner* — Pamela H Weiss
(74) *Attorney, Agent, or Firm* — Shell USA, Inc.

(57) ABSTRACT

Diesel fuel composition comprising a diesel base fuel and at least one blowing agent wherein the blowing agent is selected from ester compounds, oxalate compounds and diazene compounds and wherein the blowing agent has a solubility in diesel base fuel at 25° C. of 100 mg/kg or greater, a decomposition temperature in the range from 50° C. to 300° C. as measured by thermogravimetric analysis (TGA), and wherein the diesel fuel composition has an evaporation rate of greater than that of the diesel base fuel as measured by acoustic levitation.

11 Claims, 2 Drawing Sheets

(56) References Cited

U.S. PATENT DOCUMENTS

| | | | | |
|---|---|---|---|---|
| 3,357,865 | A | 12/1967 | Davis et al. | |
| 3,684,713 | A * | 8/1972 | Piccolini | C10M 1/08 508/464 |
| 4,029,702 | A | 6/1977 | Piccolini | |
| 4,330,304 | A | 5/1982 | Gorman | |
| 4,723,924 | A | 2/1988 | Morrison | |
| 4,723,964 | A * | 2/1988 | Jessup | C10L 1/226 44/328 |
| 4,740,215 | A * | 4/1988 | Dillon | C10L 10/12 44/398 |
| 5,313,002 | A * | 5/1994 | De Heij | C11B 9/0034 568/667 |
| 5,349,188 | A | 9/1994 | Maggard | |
| 5,378,348 | A | 1/1995 | Davis et al. | |
| 5,562,742 | A | 10/1996 | Kolp et al. | |
| 5,766,274 | A | 6/1998 | Wittenbrink et al. | |
| 5,888,376 | A | 3/1999 | Wittenbrink et al. | |
| 6,204,426 | B1 | 3/2001 | Miller et al. | |
| 8,048,175 | B2 * | 11/2011 | Yang | C10G 29/20 44/328 |
| 8,795,394 | B2 | 8/2014 | Sugano | |
| 9,222,047 | B2 | 12/2015 | Brewer | |
| 2004/0104377 | A1 | 6/2004 | Phelps et al. | |
| 2005/0229479 | A1 * | 10/2005 | Fernandes | C10L 1/14 44/329 |
| 2008/0032913 | A1 * | 2/2008 | Finke | C10L 1/19 512/17 |
| 2009/0013591 | A1 * | 1/2009 | Bradin | C10L 1/023 44/452 |
| 2010/0083567 | A1 * | 4/2010 | Korber | C10L 1/1905 44/398 |
| 2011/0020940 | A1 * | 1/2011 | Knapton | C10L 1/226 436/60 |
| 2011/0056517 | A1 * | 3/2011 | Motsenbocker | C11D 7/5027 510/200 |
| 2012/0180383 | A1 * | 7/2012 | Ford | C10L 10/08 44/398 |
| 2014/0230320 | A1 | 8/2014 | Prakash et al. | |
| 2015/0284652 | A1 | 10/2015 | Prakash | |

FOREIGN PATENT DOCUMENTS

| | | | | |
|---|---|---|---|---|
| CN | 1213694 | A | 4/1999 | |
| CN | 102746906 | A * | 10/2012 | C03C 17/3644 |
| DE | 202006019072 | U1 | 3/2007 | |
| EP | 0583836 | A1 | 2/1994 | |
| EP | 0981959 | A1 | 3/2000 | |
| EP | 1101813 | A1 | 5/2001 | |
| EP | 1632665 | A1 * | 3/2006 | C10L 1/1616 |
| GB | 2460460 | A | 12/2009 | |
| JP | 2000072604 | A | 3/2000 | |
| JP | 2001262241 | A | 9/2001 | |
| RU | 2129587 | C1 | 4/1999 | |
| RU | 2187541 | C1 | 8/2002 | |
| WO | 9714768 | A1 | 4/1997 | |
| WO | 9714769 | A1 | 4/1997 | |
| WO | 0011116 | A1 | 3/2000 | |
| WO | 0011117 | A1 | 3/2000 | |
| WO | 0020534 | A1 | 4/2000 | |
| WO | 0020535 | A1 | 4/2000 | |
| WO | 0183406 | A2 | 11/2001 | |
| WO | 0183641 | A2 | 11/2001 | |
| WO | 0183647 | A2 | 11/2001 | |
| WO | 0183648 | A2 | 11/2001 | |
| WO | 2009120563 | A1 | 10/2009 | |
| WO | 2012153133 | A1 | 11/2012 | |

OTHER PUBLICATIONS

Combustion Studies of Acoustically Suspended Liquid Droplets Dep of Mechanical Engineering Corvallis OR 93331 Mar. 1988 Contract Report BRL-CR-594 (Year: 1988).*

International Search Report and Written Opinion received for PCT Patent Application No. PCT/EP2019/058704, dated May 7, 2019, 12 pages.

International Search Report and Written Opinion received for PCT Patent Application No. PCT/US2015/024605, dated Jul. 6, 2015, 8 pages.

International Search Report and Written Opinion received for PCT Patent Application No. PCT/US2014/016866, dated May 19, 2014, 9 pages.

Hashimoto et al., "Effects of Azo Compounds on the Cetane Number Rating of Diesel Fuels", Sekiyu Gakkai Shi—Journal of the Japan Petroleum Institute, vol. 39, Issue No. 2, Jan. 1, 1996, pp. 166-169, XP055290798.

Database WPI, Week 201329,Thomson Scientific, London, Accession No. 2013-B14421, XP002784897.

Office Action Received for CN Application No. 201980026609.7, dated Dec. 3, 2021, 20 Pages(11 Pages of English Translation and 09 Pages of Official Copy).

Office Action Received for Russian Application No. 2020138008, dated Jun. 24, 2022, 19 Pages(8 Pages of English Translation and 11 Pages of Official Copy).

* cited by examiner

DIESEL FUEL WITH IMPROVED IGNITION CHARACTERISTICS

CROSS REFERENCE TO RELATED APPLICATIONS

This is a national stage application of International Application No. PCT/EP2019/058704, filed 5 Apr. 2019, which claims benefit of priority to European Patent Application No. 18168402.8, filed 20 Apr. 2018.

FIELD OF THE INVENTION

The present invention relates to diesel fuels having improved ignition characteristics, more particularly to diesel fuels with enhanced cetane numbers. The present invention also relates to diesel fuels having improved evaporation characteristics.

BACKGROUND OF THE INVENTION

The cetane number of a fuel composition is a measure of its ease of ignition and combustion. With a lower cetane number fuel a compression ignition (diesel) engine tends to be more difficult to start and may run more noisily when cold; conversely a fuel of higher cetane number tends to impart easier cold starting, to lower engine noise, to alleviate white smoke ("cold smoke") caused by incomplete combustion.

There is a general preference, therefore, for a diesel fuel composition to have a high cetane number, a preference which has become stronger as emissions legislation grows increasingly stringent, and as such automotive diesel specifications generally stipulate a minimum cetane number. To this end, many diesel fuel compositions contain ignition improvers, also known as cetane boost additives or cetane (number) improvers/enhancers, to ensure compliance with such specifications and generally to improve the combustion characteristics of the fuel.

Further, thermal stability is an important attribute of diesel fuel quality because of its function as a heat transfer fluid. Poor thermal stability, for example, may result in premature fuel filter plugging.

Currently, the most commonly used diesel fuel ignition improver is 2-ethylhexyl nitrate (2-EHN), which operates by shortening the ignition delay of a fuel to which it is added. However, 2-EHN can potentially have an adverse effect on the thermal stability of a fuel as it forms free radicals on decomposition at relatively low temperatures. 2-EHN begins to decompose at about 43° C. at atmospheric pressure. Poor thermal stability also results in an increase in the products of instability reactions, such as gums, lacquers and other insoluble species. These products can block engine filters and foul fuel injectors and valves, and consequently can result in loss of engine efficiency or emissions control.

2-EHN can also be difficult to store in concentrated form as it tends to decompose, and so is prone to forming potentially explosive mixtures. Furthermore, it has been noted that 2-EHN functions most effectively under mild engine conditions.

These disadvantages mean that it would be generally desirable to replace 2-EHN, whilst at the same time maintaining acceptable combustion properties.

US2015/0284652 discloses fuel compositions comprising a diesel base fuel and at least one diheterocyclo diazene dicarboxamide compound. It is disclosed therein that diheterocyclo diazene dicarboxamide compounds such as AZDP (azodicarboyl dipiperidine) can serve to reduce the ignition delay and/or as effective cetane number improvers in diesel fuels.

US2014/230320 discloses fuel compositions comprising a diesel base fuel and at least one dihydrocarbyl diazene dicarboxamide (DHCDD). It is disclosed in the examples therein that DODD can improve the cetane number of a diesel fuel.

SUMMARY OF THE INVENTION

It has now been found that certain types of fuel additives (referred to hereinbelow as 'blowing agents') having certain chemical and physical properties can serve to reduce the ignition delay and/or as effective cetane number improvers in diesel fuels. In particular, it has been found that certain types of fuel additives (referred to herein as 'blowing agents') having certain chemical and physical properties provide increased rate of evaporation of a diesel fuel to which the fuel additive is added which in turn serves to improve combustion properties. In particular, it has been found that the fuel additives disclosed herein (referred to herein as 'blowing agents') increase the evaporation rate of a diesel fuel to which the fuel additive is added compared with the evaporation rate of an analogous diesel fuel containing AZDP (azodicarboyl dipiperidine).

According to the present invention there is provided a diesel fuel composition comprising a diesel base fuel and at least one blowing agent wherein the blowing agent is selected from ester compounds, oxalate compounds and diazene compounds and mixtures thereof and wherein the blowing agent has a solubility in diesel base fuel at 25° C. of 100 mg/kg or greater, a decomposition temperature in the range from 50° C. to 300° C. as measured by thermogravimetric analysis (TGA), and wherein the diesel fuel composition has an evaporation rate of greater than that of the diesel base fuel as measured by acoustic levitation. Preferably, the diesel fuel composition has an evaporation rate as measured by acoustic levitation of greater than an analogous composition containing AZDP instead of said blowing agent.

According to a further aspect of the present invention there is provided a use of a blowing agent for the purpose of reducing ignition delay and/or increasing the cetane number of a diesel fuel composition wherein the blowing agent is selected from ester compounds, oxalate compounds and diazene compounds and mixtures thereof wherein the blowing agent has a solubility in diesel base fuel at 25° C. of 100 mg/kg or greater, a decomposition temperature in the range from 50° C. to 300° C. as measured by thermogravimetric analysis (TGA), and wherein the blowing agent provides an evaporation rate for the diesel fuel composition of greater than that of the diesel base fuel as measured by acoustic levitation, preferably greater than that for an analogous composition containing AZDP instead of said blowing agent.

According to a further aspect of the present invention there is provided a method for reducing the ignition delay and/or increasing the cetane number of a diesel fuel composition in an internal combustion engine which method comprises adding to the diesel fuel composition an amount of a blowing agent, wherein the blowing agent is selected from ester compounds, oxalate compounds and diazene compounds and mixtures thereof and wherein the blowing agent has a solubility in diesel base fuel at 25° C. of 100 mg/kg or greater, a decomposition temperature in the range from 50° C. to 300° C. as measured by thermogravimetric analysis (TGA), and wherein the diesel fuel composition has an evaporation rate of greater than that of the diesel base fuel as measured by acoustic levitation. Preferably, the diesel fuel composition has an evaporation rate as measured by acoustic levitation of greater than an analogous composition containing AZDP instead of said blowing agent.

The blowing agents disclosed herein have been found to reduce the ignition delay and/or as effective cetane number improvers in diesel fuels and are suitable for use in modern engines.

The blowing agents disclosed herein have also been found to effectively increase the evaporation rate of a diesel fuel composition to which they are added.

Therefore according to another aspect of the present invention there is provided use of a blowing agent for increasing the evaporation rate of a diesel fuel composition to which the blowing agent is added, wherein the blowing agent is selected from ester compounds, oxalate compounds and diazene compounds and mixtures thereof, preferably wherein the blowing agent has a solubility in diesel base fuel at 25° C. of 100 mg/kg or greater and a decomposition temperature in the range from 50° C. to 300° C. as measured by thermogravimetric analysis (TGA).

According to another aspect of the present invention there is provided the use of a fuel additive compound for increasing the evaporation rate of a diesel fuel composition to which the fuel additive compound is added, wherein the fuel additive compound is selected from amyl salicylate, isoamyl salicylate, linalyl acetate, nopyl acetate, diethyl oxalate, azidomethylbenzene, diethyl azodicarboxylate, and mixtures thereof, preferably amyl salicylate, linalyl acetate, nopyl acetate and diethyl oxalate, and mixtures thereof.

BRIEF DESCRIPTION OF THE DRAWINGS

The drawings illustrate certain aspects of some of the embodiments of the invention, and should not be used to limit or define the invention.

In FIGS. 1 to 4 the dotted lines show the standard deviation from at least ten measurements and the solid lines show the average of the experimental results.

DETAILED DESCRIPTION OF THE INVENTION

Figure 1:
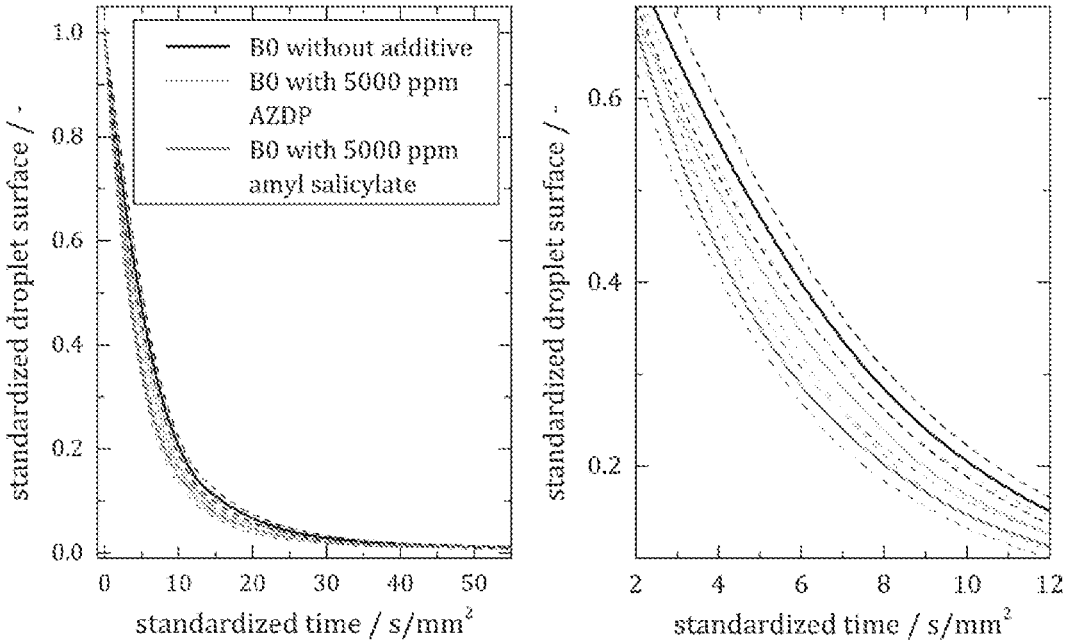
FIG. 1 illustrates the increase in evaporation rate of the diesel fuel when amyl salicylate is added at a treat rate of 5000 ppmw, and compares it to the increase in evaporation rate obtained with the addition of AZDP at the same treat rate.

In order to assist with the understanding of the invention several terms are defined herein.

The terms "cetane (number) improver" and "cetane (number) enhancer" are used interchangeably to encompass any component that, when added to a fuel composition at a suitable concentration, has the effect of increasing the cetane number of the fuel composition relative to its previous cetane number under one or more engine conditions within the operating conditions of the respective fuel or engine. As used herein, a cetane number improver or enhancer may also be referred to as a cetane number increasing additive/agent or the like.

In accordance with the present invention, the cetane number of a fuel composition may be determined in any known manner, for instance using the standard test procedure ASTM D613 (ISO 5165, IP 41) which provides a so-called "measured" cetane number obtained under engine running conditions. More preferably the cetane number may be determined using the more recent and accurate "ignition quality test" (IQT; ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels. Alternatively, cetane number may be measured by near infrared spectroscopy (NIR), as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

The composition comprises a liquid hydrocarbon fuel, to which has been added at least one blowing agent. The term 'blowing agent' as used herein means a compound which increases the evaporation rate of a fuel composition to which that compound is added.

The blowing agent may be present in the diesel fuel composition at a concentration from 0.001 to 5% w/w. Preferred amounts are from 0.005 to 5% w/w, more preferably from 0.005 to 2% w/w, with even more preferred amounts being 0.005 to 1% w/w. An especially preferred amount is from 0.005 to 0.05% w/w. The upper limit of these ranges will be determined primarily by solubility of the blowing agent in a fuel and by the cost of the blowing agent, since large amounts of additive can increase the cost of producing the fuel.

The blowing agents described herein can serve to reduce the ignition delay and/or as effective cetane number improvers in diesel fuels. Further, the blowing agents described herein can serve to increase the evaporation rate of a diesel fuel composition to which the blowing agent is added. In particular, the evaporation rate of the diesel fuel composition to which the blowing agent is added is greater than that of the diesel base fuel. In a preferred embodiment herein, the blowing agents described herein can serve to increase the evaporation rate of a diesel fuel composition to a greater extent than can be achieved by using AZDP (azodicarboyl dipiperidine).

The blowing agents for use herein are preferably selected from ester compounds, oxalate compounds and diazene compounds having certain physical characteristics as described hereinbelow. Mixtures of these blowing agents are also useful herein. These compounds were selected as they contain either a carbonyl group ($R_2C{=}O$) or an azo group ($R{-}N{=}N{-}R$) and are a source of $CO_2$ or $N_2$, respectively.

Preferred ester compounds include salicylates and acetates, and mixtures thereof. Particularly preferred ester compounds for use as the blowing agent herein include alkyl salicylates wherein the alkyl groups are straight-chain or branched and contain from 1 to 18 carbon atoms, preferably 4 to 12 carbon atoms, more preferably from 4 to 8 carbon atoms; cycloalkyl acetates wherein the cycloalkyl groups contain from 6 to 18 carbon atoms, preferably from 8 to 12 carbon atoms; cycloalkenyl acetates wherein the cycloalkenyl groups contain from 6 to 18 carbon atoms, preferably from 8 to 12 carbon atoms; and alkenyl acetates wherein the alkenyl groups contain from 6 to 18 carbon atoms, preferably from 8 to 12 carbon atoms. Most preferred ester compounds for use herein are selected from amyl salicylate, isoamyl salicylate, linalyl acetate, nopyl acetate, aquamate (1-(3,3-dimethylcyclohexyl) ethyl formiate), and mixtures thereof. In an especially preferred embodiment herein, the ester compounds are selected from amyl salicylate, linalyl acetate and nopyl acetate, and mixtures thereof.

Preferred oxalate compounds for use herein include dialkyl oxalates, wherein the alkyl groups are saturated or unsaturated, preferably saturated, and which contain from 1 to 12 carbon atoms, preferably from 1 to 4 carbon atoms, preferably methyl and ethyl. An especially preferred oxalate compound for use herein is diethyl oxalate.

Preferred diazene compounds for use as blowing agents herein include azidomethylbenzene, diethyl azodicarboxylate, and mixtures thereof.

In one embodiment herein, the blowing agent is selected from amyl salicylate, isoamyl salicylate, nopyl acetate, linalyl acetate, aquamate (1-(3,3-dimethylcyclohexyl) ethyl formiate), diethyl oxalate, azidomethyl-benzene, diethyl azodicarboxylate, and mixtures thereof.

In a preferred embodiment herein the blowing agent is selected from amyl salicylate, diethyl oxalate, linalyl acetate, nopyl acetate, and mixtures thereof.

In particular, the blowing agent for use herein has a solubility in diesel base fuel (in BO EN590 diesel base fuel) at 25° C. of 100 mg/kg or greater, preferably 1000 mg/kg or greater, more preferably 2000 mg/kg or greater.

In addition, the blowing agent for use herein has a decomposition temperature in the range from 50° C. to 300° C., preferably in the range from 90 to 225° C., as measured by thermogravimetric analysis (TGA).

As mentioned above, the blowing agents herein provide an increase in the evaporation rate of a diesel fuel to which the blowing agent is added. In particular, when the blowing agents described herein are included in a diesel fuel composition, said diesel fuel composition has an evaporation rate of greater than that of the diesel base fuel (i.e. diesel base fuel containing no blowing agent) as measured by acoustic levitation. Preferably, when the blowing agents described herein are included in a diesel fuel composition, said diesel fuel composition has an evaporation rate which is greater than the evaporation rate of an analogous diesel fuel composition containing AZDP, as measured by acoustic levitation.

The acoustic levitation test method for use herein for measuring the evaporation rate of diesel fuels to which the blowing agents are added is described in the following text book: R. Sedelmeyer "Untersuchung der radikalischen Polymerisation von N-Vinyl-2-pyrrolidon in akustisch levitierten Einzeltropfen: Vom Tropfen zum Partikel" Wissenschaft & Technik Verlag (2016) ISBN 3896852558. In the acoustic levitation test method used herein, the only change to the test method described in the text book above is that the experiments are performed at 230° C. and every experiment is repeated at least ten times.

The blowing agent can be added with a hydrocarbon compatible co-solvent that can enhance miscibility of the blowing agent to the hydrocarbon base fuel such as, for example, alcohol. However, the blowing agent can be used in the fuel without the use of a co-solvent due to its miscibility in fuel. If co-solvent is used, alcohol having 1 to 20 carbon atoms are preferred. Alcohol having 2 to 18 carbons atoms are further preferred for vehicle use. The amount of co-solvent if present in the composition can be in the range of from 0 to 10% w/w, preferably 0 to 5% w/w, based on the fuel composition.

The fuel compositions to which the present invention relates include diesel fuels for use in automotive compression ignition engines, as well as in other types of engine such as for example marine, railroad and stationary engines, and industrial gas oils for use in heating applications (e.g. boilers).

The base fuel may itself comprise a mixture of two or more different diesel fuel components, and/or be additivated as described below.

Such diesel fuels will contain a base fuel which may typically comprise liquid hydrocarbon middle distillate gas oil(s), for instance petroleum derived gas oils. Such fuels will typically have boiling points with the usual diesel range of 150 to 400° C., depending on grade and use. They will typically have a density from 750 to 900 kg/m$^3$, preferably from 800 to 860 kg/m$^3$, at 15° C. (e.g. ASTM D4502 or IP 365) and a cetane number (ASTM D613) from 35 to 80, more preferably from 40 to 75. They will typically have an initial boiling point in the range 150 to 230° C. and a final boiling point in the range 290 to 400° C. Their kinematic viscosity at 40° C. (ASTM D445) might suitably be from 1.5 to 4.5 mm$^2$/s.

Such industrial gas oils will contain a base fuel which may comprise fuel fractions such as the kerosene or gas oil fractions obtained in traditional refinery processes, which upgrade crude petroleum feedstock to useful products. Preferably such fractions contain components having carbon numbers in the range 5-40, more preferably 5-31, yet more preferably 6-25, most preferably 9-25, and such fractions have a density at 15° C. of 650-950 kg/m$^3$, a kinematic viscosity at 20° C. of 1-80 mm$^2$/s, and a boiling range of 150-400° C. Optionally, non-mineral oil based fuels, such as bio-fuels or Fischer Tropsch derived fuels, may also form or be present in the fuel composition.

A petroleum derived gas oil, e.g. obtained from refining and optionally (hydro)processing a crude petroleum source, may be incorporated into a diesel fuel composition. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit, and gas oil as obtained from a hydrocracker unit. Optionally, a petroleum derived gas oil may comprise some petroleum derived kerosene fraction. Such gas oils may be processed in a hydro-desulfurisation (HDS) unit so as to reduce their sulfur content to a level suitable for inclusion in a diesel fuel composition. This also tends to reduce the content of other polar species such as oxygen- or nitrogen-containing species. In some cases, the fuel composition will include one or more cracked products obtained by splitting heavy hydrocarbons.

The amount of Fischer-Tropsch derived fuel used in a diesel fuel composition may be from 0.5 to 100% v of the overall diesel fuel composition, preferably from 5 to 75% v. It may be desirable for the composition to contain 10% v or greater, more preferably 20% v or greater, still more preferably 30% v or greater, of the Fischer-Tropsch derived fuel. It is particularly preferred for the composition to contain 30 to 75% v, and particularly 30 or 70% v, of the Fischer Tropsch derived fuel. The balance of the fuel composition is made up of one or more other fuels.

An industrial gas oil composition may comprise more than 50 wt %, more preferably more than 70 wt %, of a Fischer Tropsch derived fuel component, if present. Fischer-Tropsch fuels may be derived by converting gas, biomass or coal to liquid (XtL), specifically by gas to liquid conversion (GtL), or from biomass to liquid conversion (BtL). Any form of Fischer-Tropsch derived fuel component may be used as a base fuel in accordance with the invention. Such a Fischer Tropsch derived fuel component is any fraction of the middle distillate fuel range, which can be isolated from the (hydrocracked) Fischer Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to 370° C. Examples of Fischer-Tropsch derived kerosene and gas oils are described in EP A 0583836, WO A 97/14768, WO A 97/14769, WO A 00/11116, WO A 00/11117, WO A 01/83406, WO A 01/83648, WO A 01/83647, WO A 01/83641, WO A 00/20535, WO A 00/20534, EP A 1101813, U.S. Pat. No. 5,766,274, U.S. Pat. No. 5,378,348, U.S. Pat. No. 5,888,376 and U.S. Pat. No. 6,204,426.

The Fischer-Tropsch product will suitably contain more than 80 wt % and more suitably more than 95 wt % iso and normal paraffins and less than 1 wt % aromatics, the balance being naphthenics compounds. The content of sulfur and nitrogen will be very low and normally below the detection limits for such compounds. For this reason the sulfur content of a fuel composition containing a Fischer-Tropsch product may be very low.

The fuel composition preferably contains no more than 5000 ppmw sulfur, more preferably no more than 500 ppmw, or no more than 350 ppmw, or no more than 150 ppmw, or no more than 100 ppmw, or no more than 50 ppmw, or most preferably no more than 10 ppmw sulfur.

In some embodiments of the present invention, the base fuel may be or contain another so-called "biodiesel" fuel component, such as a vegetable oil, hydrogenated vegetable oil or vegetable oil derivative (e.g. a fatty acid ester, in particular a fatty acid methyl ester, FAME), or another oxygenate such as an acid, ketone or ester. Such components need not necessarily be bio-derived. Where the fuel composition contains a biodiesel component, the biodiesel component may be present in quantities up to 100%, such as between 1% and 99% w/w, between 2% and 80% w/w, between 2% and 50% w/w, between 3% and 40% w/w, between 4% and 30% w/w, or between 5% and 20% w/w. In one embodiment the biodiesel component may be FAME.

The blowing agents described herein may be used to increase the cetane number of a fuel composition. As used herein, an "increase" in the context of cetane number embraces any degree of increase compared to a previously measured cetane number under the same or equivalent conditions. Thus, the increase is suitably compared to the cetane number of the same fuel composition prior to incorporation of the cetane number increasing (or improving) component or additive. Alternatively, the cetane number increase may be measured in comparison to an otherwise analogous fuel composition (or batch or the same fuel composition) that does not include the cetane number enhancer of the invention. Alternatively, an increase in cetane number of a fuel relative to a comparative fuel may be inferred by a measured increase in combustability or a measured decrease in ignition delay for the comparative fuels.

The increase in cetane number (or the decrease in ignition delay, for example) may be measured and/or reported in any suitable manner, such as in terms of a percentage increase or decrease. By way of example, the percentage increase or decrease may be at least 1%, such as at least 2%, (for example, at a dosage level of 0.05%). Suitably, the percentage increase in cetane number or decrease in ignition delay is at least 5%, at least 10%. However, it should be appreciated that any measurable improvement in cetane number or ignition delay may provide a worthwhile advantage, depending on what other factors are considered important, e.g. availability, cost, safety and so on.

The engine in which the fuel composition of the invention is used may be any appropriate engine. Thus, where the fuel is a diesel or biodiesel fuel composition, the engine is a diesel or compression ignition engine. Likewise, any type of diesel engine may be used, such as a turbo charged diesel engine, provided the same or equivalent engine is used to measure fuel economy with and without the cetane number increasing component. Similarly, the invention is applicable to an engine in any vehicle. Generally, the cetane number improvers of the invention are suitable for use over a wide range of engine working conditions.

The remainder of the composition will typically consist of one or more automotive base fuels optionally together with one or more fuel additives, for instance as described in more detail below.

The relative proportions of the cetane number enhancer, fuel components and any other components or additives present in a diesel fuel composition prepared according to the invention may also depend on other desired properties such as density, emissions performance and viscosity.

Thus, in addition to the blowing agent described herein, a diesel fuel composition prepared according to the present invention may comprise one or more diesel fuel components of conventional type. It may, for example, include a major proportion of a diesel base fuel, for instance of the type described below. In this context, a "major proportion" means at least 50% w/w, and typically at least 75% w/w based on the overall composition, more suitably, at least 80% w/w or even at least 85% w/w. In some cases at least 90% w/w or at least 95% w/w of the fuel composition consists of the diesel base fuel. Furthermore, in some cases at least 95% w/w or at least 99.99% w/w of the fuel composition consists of the diesel base fuel.

Such fuels are generally suitable for use in compression ignition (diesel) internal combustion engines, of either the indirect or direct injection type.

An automotive diesel fuel composition which results from carrying out the present invention will also suitably fall within these general specifications. Accordingly, it will generally comply with applicable current standard specification(s) such as for example EN 590 (for Europe) or ASTM D975 (for the USA). By way of example, the fuel composition may have a density from 0.82 to 0.845 g/cm$^3$ at 15° C.; a $T_{95}$ boiling point (ASTM D86) of 360° C. or less; a cetane number (ASTM D613) of 45 or greater; a kinematic viscosity (ASTM D445) from 2 to 4.5 $mm^2/s$ at 40° C.; a sulfur content (ASTM D2622) of 50 mg/kg or less; and/or a polycyclic aromatic hydrocarbons (PAH) content (IP391 (mod)) of less than 11% w/w. Relevant specifications may, however, differ from country to country and from year to year and may depend on the intended use of the fuel composition.

In particular, its measured cetane number will preferably be from 40 to 70. The present invention suitably results in a fuel composition which has a derived cetane number (IP 498) of 40 or greater, more preferably of 41, 42, 43, or 44 or greater.

Furthermore, a fuel composition prepared according to the present invention, or a base fuel used in such a composition may contain one or more fuel additives, or may be additive-free. If additives are included (e.g. added to the fuel at the refinery), it may contain minor amounts of one or more additives. Selected examples or suitable additives include (but are not limited to): anti-static agents; pipeline drag reducers; flow improvers (e.g. ethylene/vinyl acetate copolymers or acrylate/maleic anhydride copolymers); lubricity enhancing additives (e.g. ester- and acid-based additives); viscosity improving additives or viscosity modifiers (e.g. styrene-based copolymers, zeolites, and high viscosity fuel or oil derivatives); dehazers (e.g. alkoxylated phenol formaldehyde polymers); anti-foaming agents (e.g. polyether-modified polysiloxanes); anti-rust agents (e.g. a propane-1, 2-diol semi-ester of tetrapropenyl succinic acid, or polyhydric alcohol esters of a succinic acid derivative); corrosion inhibitors; reodorants; anti-wear additives; antioxidants (e.g. phenolics such as 2,6-di-tert-butylphenol); metal deactivators; combustion improvers; static dissipator additives; cold flow improvers (e.g. glycerol monooleate, di-isodecyl adipate); antioxidants; and wax anti-settling agents. The composition may for example contain a detergent. Detergent-containing diesel fuel additives are known and commercially available. Such additives may be added to diesel fuels at levels intended to reduce, remove or slow the build up of engine deposits. In some embodiments, it may be advantageous for the fuel composition to contain an anti-foaming agent, more preferably in combination with an anti-rust agent and/or a corrosion inhibitor and/or a lubricity enhancing additive.

Where the composition contains such additives (other than the blowing agent described herein and/or co-solvent), it suitably contains a minor proportion (such as 1% w/w or less, 0.5% w/w or less, 0.2% w/w or less), of the one or more other fuel additives, in addition to the blowing agent. Unless otherwise stated, the (active matter) concentration of each such other additive component in the fuel composition may be up to 10000 ppmw, such as in the range of 0.1 to 1000 ppmw; and advantageously from 0.1 to 300 ppmw, such as from 0.1 to 150 ppmw.

If desired, one or more additive components, such as those listed above, may be co-mixed (e.g. together with suitable diluent) in an additive concentrate, and the additive concentrate may then be dispersed into a base fuel or fuel composition. In some cases, it may be possible and convenient to incorporate the cetane number increasing component of the invention into such an additive formulation. Thus, the blowing agent described herein may be pre-diluted in one or more such fuel components, prior to its incorporation into the final automotive fuel composition. Such a fuel additive mixture may typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol (e.g. 1-butanol, hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

The total content of the additives in the fuel composition may be suitably between 0 and 10000 ppmw and more suitably below 5000 ppmw.

As used herein, amounts (e.g. concentrations, ppmw and % w/w) of components are of active matter, i.e. exclusive of volatile solvents/diluent materials.

In one embodiment, the present invention involves adjusting the cetane number of the fuel composition, using the cetane number enhancing component/blowing agent, in order to achieve a desired target cetane number.

The maximum cetane number of an automotive fuel composition may often be limited by relevant legal and/or commercial specifications, such as the European diesel fuel specification EN 590 that stipulates a cetane number of 51. Thus, typical commercial automotive diesel fuels for use in Europe are currently manufactured to have cetane numbers of around 51. Thus, the present invention may involve manipulation of an otherwise standard specification diesel fuel composition, using a cetane number enhancing additive/blowing agent, to increase its cetane number so as to improve the combustability of the fuel, and hence reduce engine emissions and even fuel economy of an engine into which it is, or is intended to be, introduced.

Suitably, the cetane number improver/blowing agent increases the cetane number of the fuel composition by at least 2, preferably at least 3, cetane numbers. Accordingly, in other embodiments, the cetane number of the resultant fuel is between 42 and 60, preferably between 43 and 60.

An automotive diesel fuel composition prepared according to the present invention will suitably comply with applicable current standard specification(s) such as, for example, EN 590 (for Europe) or ASTM D-975 (for the USA). By way of example, the overall fuel composition may have a density from 820 to 845 $kg/m^3$ at 15° C. (ASTM D-4052 or EN ISO 3675); a T95 boiling point (ASTM D-86 or EN ISO 3405) of 360° C. or less; a measured cetane number (ASTM D-613) of 51 or greater; a VK 40 (ASTM D-445 or EN ISO 3104) from 2 to 4.5 $mm^2/s$; a sulfur content (ASTM D-2622 or EN ISO 20846) of 50 mg/kg or less; and/or a polycyclic aromatic hydrocarbons (PAH) content (IP 391 (mod)) of less than 11% w/w. Relevant specifications may, however, differ from country to country and from year to year, and may depend on the intended use of the fuel composition.

It will be appreciated, however, that diesel fuel composition prepared according to the present invention may contain fuel components with properties outside of these ranges, since the properties of an overall blend may differ, often significantly, from those of its individual constituents.

In accordance with one aspect of the invention, there is provided the use of a blowing agent as described herein to achieve a desired cetane number of the resultant fuel composition. In some embodiments the desired cetane number is achieved or intended to be achieved under a specified set or range of engine working conditions, as described elsewhere herein. Accordingly, an advantage of the present invention is that blowing agent described herein may be suitable for reducing the combustion delay of a fuel composition under all engine running conditions, or under mild, or under harsh engine conditions, or demanding engine such as turbo charged engine.

In operating a compression ignition engine and/or a vehicle which is powered by such an engine, the diesel fuel composition discussed above is introducing into a combustion chamber of the engine and then running (or operating) the engine.

The blowing agents described herein may serve to improve combustion and, hence, improve associated engine factors, such as exhaust emissions and/or engine deposits under a range of engine operating conditions. The blowing agents described herein may also be used as an additive for gasoline.

To facilitate a better understanding of the present invention, the following examples of certain aspects of some embodiments are given. In no way should the following examples be read to limit, or define, the entire scope of the invention.

ILLUSTRATIVE EMBODIMENTS

The fuel blends in Examples 1 to 4 were prepared with a B0 diesel base fuel (B0 denotes that the diesel base fuel contains 0% biofuel) which met the EN590 diesel fuel specification.

Examples 1-4

Amyl salicylate (commercially available from Zanos (UK)) was blended in the diesel base fuel. Procedure to prepare 5 g of blend solution containing 0.5% amyl salicylate and base fuel is as follows: 0.025 g of amyl salicylate was added to 4.975 g of base fuel in a glass container and stirred until a clear homogeneous solution was obtained (Example 1).

Diethyl oxalate (commercially available from Akos) was blended in the diesel base fuel. Procedure to prepare 5 g of blend solution containing 0.5% diethyl oxalate and base fuel is as follows: 0.025 g of diethyl oxalate was added to 4.975 g of base fuel in a glass container and stirred until a clear homogeneous solution was obtained (Example 2).

Linalyl acetate (commercially available from Zanos (UK)) was blended in the diesel base fuel. Procedure to prepare 5 g of blend solution containing 0.5% linalyl acetate and base fuel is as follows: 0.025 g of linalyl acetate was added to 4.975 g of base fuel in a glass container and stirred until a clear homogeneous solution was obtained (Example 3).

Nopyl acetate (commercially available from Zanos (UK)) was blended in the diesel base fuel. Procedure to prepare 5 g of blend solution containing 0.5% nopyl acetate and base fuel is as follows: 0.025 g of nopyl acetate was added to 4.975 g of base fuel in a glass container and stirred until a clear homogeneous solution was obtained (Example 4).

Comparative Example 1

Azodicarboyl dipiperidine (AZDP) (commercially available from Sigma-Aldrich) was blended in the diesel base fuel.

Procedure to prepare 5 g of blend solution containing 0.5% AZDP and base fuel is as follows: 0.025 g of AZDP was added to 4.975 g of base fuel in a glass container and stirred until a clear homogenous solution was obtained (Comparative Example 1).

The evaporation rate of each of the diesel fuel blends of Examples 1-4 and Comparative Example 1 was measured according to the Acoustic Levitation Test Method described in R. Sedelmeyer "Untersuchung der radikalischen Polymerisation von N-Vinyl-2-pyrrolidon in akustisch levitierten Einzeltropfen: Vom Tropfen zum Partikel" Wissenschaft & Technik Verlag (2016) ISBN 3896852558. The only change to the test method described in the above reference was that the experiments were performed at 230° C. and every experiment was repeated at least ten times.

The results from the acoustic levitation experiments are shown in Table 1 below:

TABLE 1

| | BO (diesel without additives) | | BO with 5000 ppm AZDP | | BO with 5000 ppm Nopyl acetate | | BO with 5000 ppm Diethyl oxalate | | BO with 5000 ppm Amyl salicylate | | BO with 5000 ppm Linalyl acetate | |
|---|---|---|---|---|---|---|---|---|---|---|---|---|
| Standardized time/ s/mm$^2$ | Standardized droplet surface/— | Standard deviation | Standardized droplet surface/— | standard deviation | Standardized droplet surface/— | standard deviation | Standardized droplet surface/— | standard deviation | Standardized droplet surface/— | standard deviation | Standardized droplet surface/— | standard deviation |
| 0.0000 | 1.0000 | 0.0126 | 1.0041 | 0.0000 | 1.0024 | 0.0127 | 0.9961 | 0.0089 | 0.9967 | 0.0089 | 0.9998 | 0.0049 |
| 0.6002 | 0.9059 | 0.0263 | 0.8895 | 0.0296 | 0.7580 | 0.0706 | 0.7986 | 0.0567 | 0.7790 | 0.0451 | 0.7731 | 0.0391 |
| 1.2004 | 0.8345 | 0.0364 | 0.7813 | 0.0325 | 0.5832 | 0.0644 | 0.6222 | 0.0637 | 0.5921 | 0.0388 | 0.5951 | 0.0454 |
| 1.8006 | 0.7663 | 0.0426 | 0.7100 | 0.0340 | 0.4437 | 0.0445 | 0.4734 | 0.0598 | 0.4421 | 0.0257 | 0.4363 | 0.0354 |
| 2.4007 | 0.7030 | 0.0438 | 0.6498 | 0.0326 | 0.3417 | 0.0381 | 0.3573 | 0.0525 | 0.3355 | 0.0198 | 0.3203 | 0.0304 |
| 3.0009 | 0.6437 | 0.0422 | 0.5866 | 0.0313 | 0.2640 | 0.0330 | 0.2728 | 0.0449 | 0.2608 | 0.0195 | 0.2424 | 0.0283 |
| 3.6011 | 0.5883 | 0.0400 | 0.5312 | 0.0302 | 0.2081 | 0.0314 | 0.2101 | 0.0385 | 0.2083 | 0.0183 | 0.1896 | 0.0269 |
| 4.2013 | 0.5361 | 0.0370 | 0.4805 | 0.0287 | 0.1678 | 0.0288 | 0.1668 | 0.0318 | 0.1683 | 0.0158 | 0.1518 | 0.0233 |
| 4.8015 | 0.4873 | 0.0339 | 0.4318 | 0.0275 | 0.1343 | 0.0261 | 0.1378 | 0.0261 | 0.1387 | 0.0139 | 0.1279 | 0.0171 |
| 5.4016 | 0.4416 | 0.0308 | 0.3866 | 0.0268 | 0.1085 | 0.0213 | 0.1151 | 0.0225 | 0.1170 | 0.0134 | 0.1103 | 0.0171 |
| 6.0018 | 0.3992 | 0.0283 | 0.3461 | 0.0263 | 0.0956 | 0.0153 | 0.0974 | 0.0194 | 0.0981 | 0.0123 | 0.0953 | 0.0163 |
| 6.6020 | 0.3605 | 0.0261 | 0.3084 | 0.0266 | 0.0867 | 0.0130 | 0.0835 | 0.0161 | 0.0832 | 0.0112 | 0.0829 | 0.0160 |
| 7.2022 | 0.3253 | 0.0243 | 0.2763 | 0.0264 | 0.0789 | 0.0177 | 0.0720 | 0.0152 | 0.0720 | 0.0105 | 0.0726 | 0.0150 |
| 7.8024 | 0.2936 | 0.0229 | 0.2470 | 0.0257 | 0.0686 | 0.0153 | 0.0629 | 0.0139 | 0.0627 | 0.0098 | 0.0635 | 0.0138 |
| 8.4026 | 0.2655 | 0.0214 | 0.2210 | 0.0250 | 0.0603 | 0.0136 | 0.0552 | 0.0121 | 0.0551 | 0.0090 | 0.0560 | 0.0127 |
| 9.0027 | 0.2406 | 0.0199 | 0.1987 | 0.0241 | 0.0541 | 0.0138 | 0.0486 | 0.0112 | 0.0488 | 0.0082 | 0.0495 | 0.0116 |
| 9.6029 | 0.2187 | 0.0184 | 0.1799 | 0.0233 | 0.0484 | 0.0108 | 0.0432 | 0.0105 | 0.0435 | 0.0077 | 0.0438 | 0.0106 |
| 10.2031 | 0.1991 | 0.0170 | 0.1640 | 0.0221 | 0.0439 | 0.0105 | 0.0383 | 0.0094 | 0.0388 | 0.0070 | 0.0388 | 0.0095 |
| 10.8033 | 0.1814 | 0.0158 | 0.1500 | 0.0208 | 0.0395 | 0.0101 | 0.0341 | 0.0085 | 0.0347 | 0.0064 | 0.0348 | 0.0091 |
| 11.4035 | 0.1654 | 0.0150 | 0.1380 | 0.0195 | 0.0365 | 0.0093 | 0.0305 | 0.0077 | 0.0312 | 0.0058 | 0.0311 | 0.0082 |
| 12.0036 | 0.1516 | 0.0145 | 0.1269 | 0.0185 | 0.0333 | 0.0086 | 0.0275 | 0.0068 | 0.0281 | 0.0052 | 0.0281 | 0.0075 |

TABLE 1-continued

| | BO (diesel without additives) | | BO with 5000 ppm AZDP | | BO with 5000 ppm Nopyl acetate | | BO with 5000 ppm Diethyl oxalate | | BO with 5000 ppm Amyl salicylate | | BO with 5000 ppm Linalyl acetate | |
|---|---|---|---|---|---|---|---|---|---|---|---|---|
| Standardized time/ s/mm$^2$ | Standardized droplet surface/— | Standard deviation | Standardized droplet surface/— | standard deviation | Standardized droplet surface/— | standard deviation | Standardized droplet surface/— | standard deviation | Standardized droplet surface/— | standard deviation | Standardized droplet surface/— | standard deviation |
| 12.6038 | 0.1401 | 0.0141 | 0.1173 | 0.0179 | 0.0304 | 0.0077 | 0.0249 | 0.0061 | 0.0256 | 0.0047 | 0.0253 | 0.0067 |
| 13.2040 | 0.1305 | 0.0135 | 0.1085 | 0.0176 | 0.0277 | 0.0072 | 0.0227 | 0.0055 | 0.0234 | 0.0042 | 0.0234 | 0.0062 |
| 13.8042 | 0.1231 | 0.0128 | 0.1007 | 0.0175 | 0.0253 | 0.0065 | 0.0209 | 0.0049 | 0.0216 | 0.0039 | 0.0215 | 0.0056 |
| 14.4044 | 0.1162 | 0.0124 | 0.0930 | 0.0167 | 0.0233 | 0.0058 | 0.0193 | 0.0044 | 0.0200 | 0.0035 | 0.0198 | 0.0051 |
| 15.0046 | 0.1094 | 0.0120 | 0.0872 | 0.0153 | 0.0218 | 0.0054 | 0.0181 | 0.0040 | 0.0186 | 0.0032 | 0.0185 | 0.0047 |
| 15.6048 | 0.1029 | 0.0114 | 0.0822 | 0.0143 | 0.0204 | 0.0051 | 0.0169 | 0.0036 | 0.0174 | 0.0029 | 0.0173 | 0.0043 |
| 16.2050 | 0.0966 | 0.0105 | 0.0770 | 0.0134 | 0.0195 | 0.0048 | 0.0160 | 0.0033 | 0.0165 | 0.0026 | 0.0163 | 0.0039 |
| 16.8051 | 0.0913 | 0.0096 | 0.0726 | 0.0132 | 0.0187 | 0.0048 | 0.0151 | 0.0030 | 0.0156 | 0.0024 | 0.0154 | 0.0036 |
| 17.4053 | 0.0864 | 0.0091 | 0.0688 | 0.0129 | 0.0179 | 0.0049 | 0.0142 | 0.0027 | 0.0149 | 0.0023 | 0.0146 | 0.0035 |
| 18.0055 | 0.0815 | 0.0088 | 0.0652 | 0.0115 | 0.0174 | 0.0050 | 0.0134 | 0.0025 | 0.0143 | 0.0021 | 0.0139 | 0.0032 |
| 18.6057 | 0.0766 | 0.0084 | 0.0617 | 0.0102 | 0.0167 | 0.0054 | 0.0128 | 0.0023 | 0.0137 | 0.0021 | 0.0134 | 0.0030 |
| 19.2059 | 0.0721 | 0.0080 | 0.0594 | 0.0096 | 0.0162 | 0.0059 | 0.0122 | 0.0022 | 0.0132 | 0.0020 | 0.0129 | 0.0028 |
| 19.8060 | 0.0681 | 0.0076 | 0.0571 | 0.0097 | 0.0159 | 0.0064 | 0.0115 | 0.0025 | 0.0128 | 0.0018 | 0.0124 | 0.0027 |
| 20.4062 | 0.0646 | 0.0074 | 0.0547 | 0.0101 | 0.0156 | 0.0069 | 0.0113 | 0.0028 | 0.0125 | 0.0018 | 0.0120 | 0.0026 |
| 21.0064 | 0.0614 | 0.0073 | 0.0525 | 0.0104 | 0.0152 | 0.0075 | 0.0109 | 0.0033 | 0.0122 | 0.0019 | 0.0116 | 0.0025 |
| 21.6066 | 0.0582 | 0.0072 | 0.0505 | 0.0106 | 0.0149 | 0.0081 | 0.0104 | 0.0037 | 0.0119 | 0.0020 | 0.0113 | 0.0024 |
| 22.2068 | 0.0549 | 0.0070 | 0.0486 | 0.0103 | 0.0146 | 0.0087 | 0.0100 | 0.0042 | 0.0117 | 0.0021 | 0.0110 | 0.0023 |
| 22.8070 | 0.0518 | 0.0067 | 0.0463 | 0.0100 | 0.0143 | 0.0094 | 0.0096 | 0.0048 | 0.0114 | 0.0023 | 0.0107 | 0.0023 |
| 23.4071 | 0.0489 | 0.0065 | 0.0443 | 0.0096 | 0.0139 | 0.0101 | 0.0092 | 0.0054 | 0.0112 | 0.0025 | 0.0104 | 0.0022 |
| 24.0073 | 0.0463 | 0.0063 | 0.0425 | 0.0091 | 0.0136 | 0.0108 | 0.0089 | 0.0060 | 0.0110 | 0.0028 | 0.0102 | 0.0022 |
| 24.6075 | 0.0439 | 0.0062 | 0.0407 | 0.0088 | 0.0133 | 0.0116 | 0.0085 | 0.0066 | 0.0108 | 0.0030 | 0.0100 | 0.0022 |
| 25.2077 | 0.0417 | 0.0060 | 0.0391 | 0.0083 | 0.0130 | 0.0123 | 0.0081 | 0.0073 | 0.0106 | 0.0033 | 0.0098 | 0.0021 |
| 25.8079 | 0.0397 | 0.0058 | 0.0373 | 0.0080 | 0.0126 | 0.0131 | 0.0078 | 0.0079 | 0.0105 | 0.0036 | 0.0097 | 0.0021 |
| 26.4080 | 0.0378 | 0.0056 | 0.0360 | 0.0076 | 0.0123 | 0.0138 | 0.0075 | 0.0085 | 0.0104 | 0.0039 | 0.0095 | 0.0021 |
| 27.0083 | 0.0361 | 0.0054 | 0.0344 | 0.0072 | 0.0120 | 0.0146 | 0.0072 | 0.0092 | 0.0102 | 0.0042 | 0.0093 | 0.0021 |
| 27.6084 | 0.0344 | 0.0052 | 0.0331 | 0.0069 | 0.0117 | 0.0154 | 0.0068 | 0.0098 | 0.0101 | 0.0045 | 0.0091 | 0.0024 |
| 28.2086 | 0.0329 | 0.0051 | 0.0320 | 0.0065 | 0.0113 | 0.0161 | 0.0065 | 0.0105 | 0.0099 | 0.0049 | 0.0091 | 0.0019 |
| 28.8089 | 0.0315 | 0.0049 | 0.0307 | 0.0062 | 0.0110 | 0.0169 | 0.0062 | 0.0112 | 0.0098 | 0.0052 | 0.0090 | 0.0019 |
| 29.4090 | 0.0301 | 0.0047 | 0.0295 | 0.0059 | 0.0107 | 0.0177 | 0.0059 | 0.0118 | 0.0097 | 0.0055 | 0.0089 | 0.0019 |
| 30.0091 | 0.0289 | 0.0044 | 0.0283 | 0.0056 | 0.0104 | 0.0185 | 0.0056 | 0.0125 | 0.0095 | 0.0059 | 0.0088 | 0.0019 |
| 30.6092 | 0.0277 | 0.0041 | 0.0271 | 0.0054 | 0.0100 | 0.0193 | 0.0053 | 0.0131 | 0.0094 | 0.0062 | 0.0085 | 0.0019 |
| 31.2096 | 0.0266 | 0.0038 | 0.0262 | 0.0051 | 0.0097 | 0.0201 | 0.0049 | 0.0138 | 0.0092 | 0.0065 | 0.0083 | 0.0019 |
| 31.8097 | 0.0256 | 0.0037 | 0.0253 | 0.0049 | 0.0094 | 0.0209 | 0.0046 | 0.0144 | 0.0091 | 0.0069 | 0.0082 | 0.0019 |
| 32.4098 | 0.0247 | 0.0035 | 0.0244 | 0.0047 | 0.0091 | 0.0217 | 0.0043 | 0.0151 | 0.0089 | 0.0072 | 0.0081 | 0.0020 |
| 33.0102 | 0.0238 | 0.0033 | 0.0237 | 0.0045 | 0.0087 | 0.0225 | 0.0040 | 0.0157 | 0.0088 | 0.0076 | 0.0080 | 0.0020 |
| 33.6103 | 0.0230 | 0.0032 | 0.0230 | 0.0043 | 0.0084 | 0.0233 | 0.0036 | 0.0164 | 0.0086 | 0.0079 | 0.0079 | 0.0020 |
| 34.2104 | 0.0222 | 0.0031 | 0.0221 | 0.0041 | 0.0081 | 0.0241 | 0.0033 | 0.0171 | 0.0085 | 0.0083 | 0.0078 | 0.0020 |
| 34.8107 | 0.0215 | 0.0029 | 0.0216 | 0.0039 | 0.0078 | 0.0249 | 0.0029 | 0.0177 | 0.0084 | 0.0086 | 0.0077 | 0.0020 |
| 35.4108 | 0.0208 | 0.0028 | 0.0209 | 0.0038 | 0.0074 | 0.0257 | 0.0026 | 0.0184 | 0.0082 | 0.0090 | 0.0076 | 0.0020 |
| 36.0109 | 0.0202 | 0.0027 | 0.0203 | 0.0036 | 0.0071 | 0.0265 | 0.0023 | 0.0190 | 0.0081 | 0.0093 | 0.0075 | 0.0021 |
| 36.6111 | 0.0196 | 0.0026 | 0.0196 | 0.0035 | 0.0068 | 0.0273 | 0.0020 | 0.0197 | 0.0079 | 0.0097 | 0.0074 | 0.0021 |
| 37.2114 | 0.0191 | 0.0024 | 0.0191 | 0.0034 | 0.0065 | 0.0281 | 0.0017 | 0.0204 | 0.0078 | 0.0100 | 0.0073 | 0.0021 |
| 37.8115 | 0.0186 | 0.0023 | 0.0186 | 0.0032 | 0.0062 | 0.0290 | 0.0013 | 0.0210 | 0.0076 | 0.0104 | 0.0072 | 0.0021 |
| 38.4116 | 0.0181 | 0.0022 | 0.0181 | 0.0031 | 0.0058 | 0.0298 | 0.0010 | 0.0217 | 0.0075 | 0.0107 | 0.0071 | 0.0022 |
| 39.0120 | 0.0176 | 0.0021 | 0.0177 | 0.0030 | 0.0055 | 0.0306 | 0.0007 | 0.0224 | 0.0074 | 0.0111 | 0.0070 | 0.0022 |
| 39.6121 | 0.0172 | 0.0020 | 0.0172 | 0.0028 | 0.0052 | 0.0314 | 0.0004 | 0.0230 | 0.0072 | 0.0114 | 0.0069 | 0.0022 |
| 40.2122 | 0.0169 | 0.0020 | 0.0169 | 0.0028 | 0.0049 | 0.0322 | 0.0000 | 0.0237 | 0.0071 | 0.0118 | 0.0068 | 0.0023 |
| 40.8126 | 0.0165 | 0.0019 | 0.0164 | 0.0026 | 0.0045 | 0.0330 | −0.0003 | 0.0243 | 0.0069 | 0.0121 | 0.0067 | 0.0023 |
| 41.4127 | 0.0161 | 0.0019 | 0.0161 | 0.0025 | 0.0042 | 0.0338 | −0.0006 | 0.0250 | 0.0068 | 0.0125 | 0.0067 | 0.0023 |
| 42.0128 | 0.0158 | 0.0018 | 0.0157 | 0.0025 | 0.0039 | 0.0347 | −0.0009 | 0.0257 | 0.0066 | 0.0128 | 0.0067 | 0.0023 |
| 42.6129 | 0.0154 | 0.0018 | 0.0154 | 0.0024 | 0.0036 | 0.0355 | −0.0012 | 0.0263 | 0.0065 | 0.0132 | 0.0067 | 0.0024 |
| 43.2132 | 0.0151 | 0.0017 | 0.0150 | 0.0023 | 0.0032 | 0.0363 | −0.0016 | 0.0270 | 0.0063 | 0.0135 | 0.0067 | 0.0025 |
| 43.8133 | 0.0148 | 0.0017 | 0.0147 | 0.0022 | 0.0029 | 0.0371 | −0.0019 | 0.0277 | 0.0062 | 0.0139 | 0.0067 | 0.0026 |
| 44.4135 | 0.0146 | 0.0017 | 0.0144 | 0.0022 | 0.0026 | 0.0379 | −0.0022 | 0.0283 | 0.0061 | 0.0142 | 0.0066 | 0.0028 |
| 45.0138 | 0.0144 | 0.0017 | 0.0142 | 0.0021 | 0.0023 | 0.0387 | −0.0025 | 0.0290 | 0.0059 | 0.0146 | 0.0066 | 0.0030 |
| 45.6139 | 0.0141 | 0.0017 | 0.0139 | 0.0021 | 0.0019 | 0.0396 | −0.0029 | 0.0297 | 0.0058 | 0.0149 | 0.0066 | 0.0033 |
| 46.2140 | 0.0140 | 0.0017 | 0.0137 | 0.0021 | 0.0016 | 0.0404 | −0.0032 | 0.0303 | 0.0056 | 0.0153 | 0.0065 | 0.0035 |
| 46.8144 | 0.0138 | 0.0016 | 0.0136 | 0.0020 | 0.0013 | 0.0412 | −0.0036 | 0.0310 | 0.0055 | 0.0157 | 0.0065 | 0.0038 |
| 47.4145 | 0.0136 | 0.0016 | 0.0134 | 0.0019 | 0.0010 | 0.0420 | −0.0039 | 0.0317 | 0.0053 | 0.0160 | 0.0065 | 0.0041 |
| 48.0146 | 0.0134 | 0.0016 | 0.0132 | 0.0019 | 0.0006 | 0.0428 | −0.0043 | 0.0323 | 0.0052 | 0.0164 | 0.0064 | 0.0044 |
| 48.6147 | 0.0132 | 0.0016 | 0.0129 | 0.0018 | 0.0003 | 0.0436 | −0.0046 | 0.0330 | 0.0051 | 0.0167 | 0.0064 | 0.0047 |
| 49.2151 | 0.0131 | 0.0016 | 0.0127 | 0.0018 | 0.0000 | 0.0445 | −0.0049 | 0.0336 | 0.0049 | 0.0171 | 0.0064 | 0.0049 |
| 49.8152 | 0.0129 | 0.0015 | 0.0125 | 0.0018 | −0.0003 | 0.0453 | −0.0053 | 0.0343 | 0.0048 | 0.0174 | 0.0064 | 0.0052 |
| 50.4153 | 0.0127 | 0.0015 | 0.0124 | 0.0018 | −0.0007 | 0.0461 | −0.0056 | 0.0350 | 0.0046 | 0.0178 | 0.0064 | 0.0056 |
| 51.0156 | 0.0125 | 0.0015 | 0.0122 | 0.0017 | −0.0010 | 0.0469 | −0.0060 | 0.0356 | 0.0045 | 0.0182 | 0.0064 | 0.0059 |
| 51.6157 | 0.0123 | 0.0015 | 0.0119 | 0.0017 | −0.0013 | 0.0477 | −0.0063 | 0.0363 | 0.0043 | 0.0185 | 0.0063 | 0.0062 |
| 52.2158 | 0.0122 | 0.0016 | 0.0117 | 0.0017 | −0.0016 | 0.0486 | −0.0067 | 0.0370 | 0.0042 | 0.0189 | 0.0063 | 0.0065 |

TABLE 1-continued

| | BO (diesel without additives) | | BO with 5000 ppm AZDP | | BO with 5000 ppm Nopyl acetate | | BO with 5000 ppm Diethyl oxalate | | BO with 5000 ppm Amyl salicylate | | BO with 5000 ppm Linalyl acetate | |
|---|---|---|---|---|---|---|---|---|---|---|---|---|
| Standardized time/ s/mm$^2$ | Standardized droplet surface/— | Standard deviation | Standardized droplet surface/— | standard deviation | Standardized droplet surface/— | standard deviation | Standardized droplet surface/— | standard deviation | Standardized droplet surface/— | standard deviation | Standardized droplet surface/— | standard deviation |
| 52.8162 | 0.0121 | 0.0016 | 0.0116 | 0.0017 | −0.0020 | 0.0494 | −0.0070 | 0.0376 | 0.0040 | 0.0192 | 0.0063 | 0.0068 |
| 53.4163 | 0.0120 | 0.0016 | 0.0114 | 0.0016 | −0.0023 | 0.0502 | −0.0074 | 0.0383 | 0.0039 | 0.0196 | 0.0063 | 0.0071 |
| 54.0164 | 0.0118 | 0.0017 | 0.0113 | 0.0016 | −0.0026 | 0.0510 | −0.0077 | 0.0389 | 0.0038 | 0.0199 | 0.0062 | 0.0075 |
| 54.6168 | 0.0117 | 0.0016 | 0.0112 | 0.0015 | −0.0029 | 0.0518 | −0.0081 | 0.0396 | 0.0036 | 0.0203 | 0.0062 | 0.0078 |

The experimental data in Table 1 in shown in graphical form in FIGS. 1, 2, 3 and 4.

FIG. 1 shows that the evaporation rate of the diesel fuel is greater on addition of amyl salicylate compared to the evaporation rate which is obtained by using AZDP as blowing agent.

Figure 2:
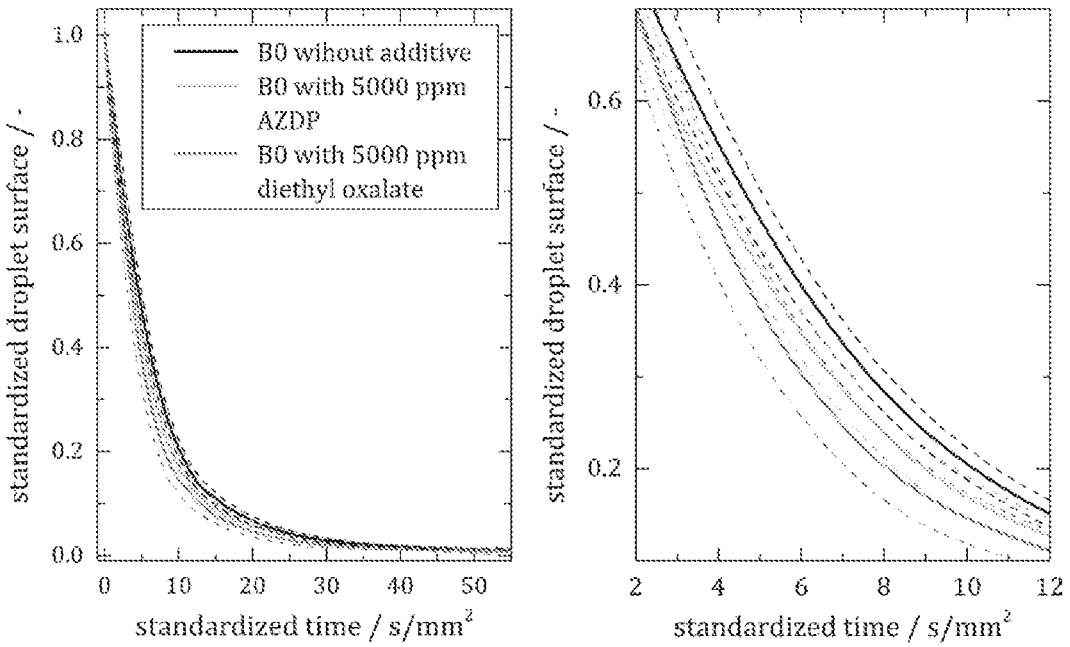
FIG. 2 illustrates the increase in evaporation rate of the diesel fuel when diethyl oxalate is added at a treat rate of 5000 ppmw, and compares it to the increase in evaporation rate obtained with the addition of AZDP at the same treat rate.

FIG. 2 shows that the evaporation rate of the diesel fuel is greater on addition of diethyl oxalate compared to the evaporation rate which is obtained by using AZDP as blowing agent.

Figure 3:
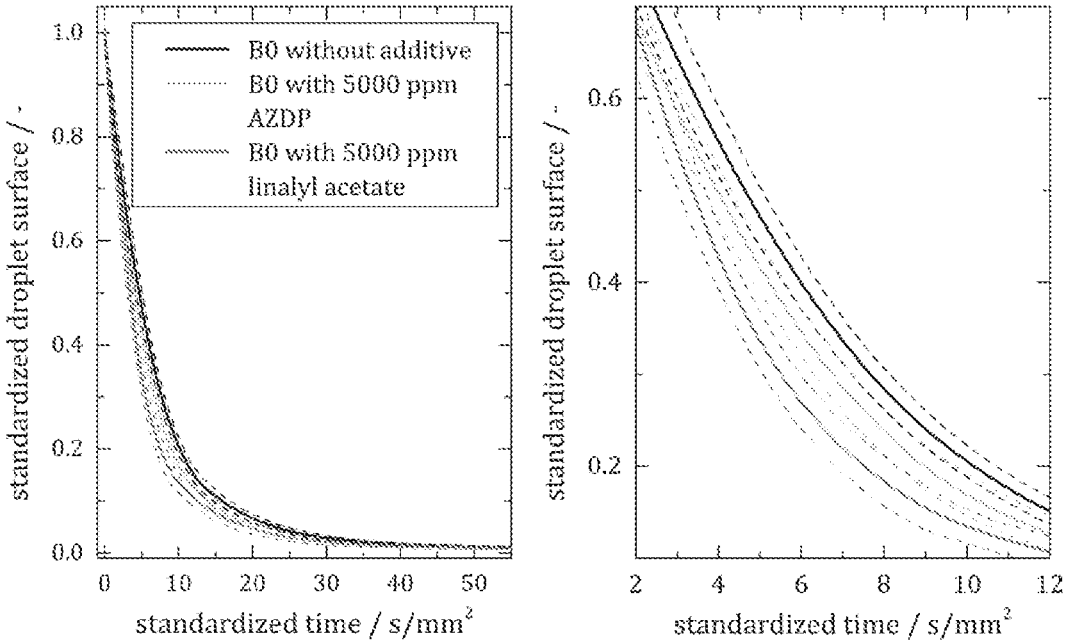
FIG. 3 illustrates the increase in evaporation rate of the diesel fuel when linalyl acetate is added at a treat rate of 5000 ppmw, and compares it to the increase in evaporation rate obtained with the addition of AZDP at the same treat rate.

FIG. 3 shows that the evaporation rate of the diesel fuel is greater on addition of linalyl acetate compared to the evaporation rate which is obtained by using AZDP as blowing agent.

Figure 4:
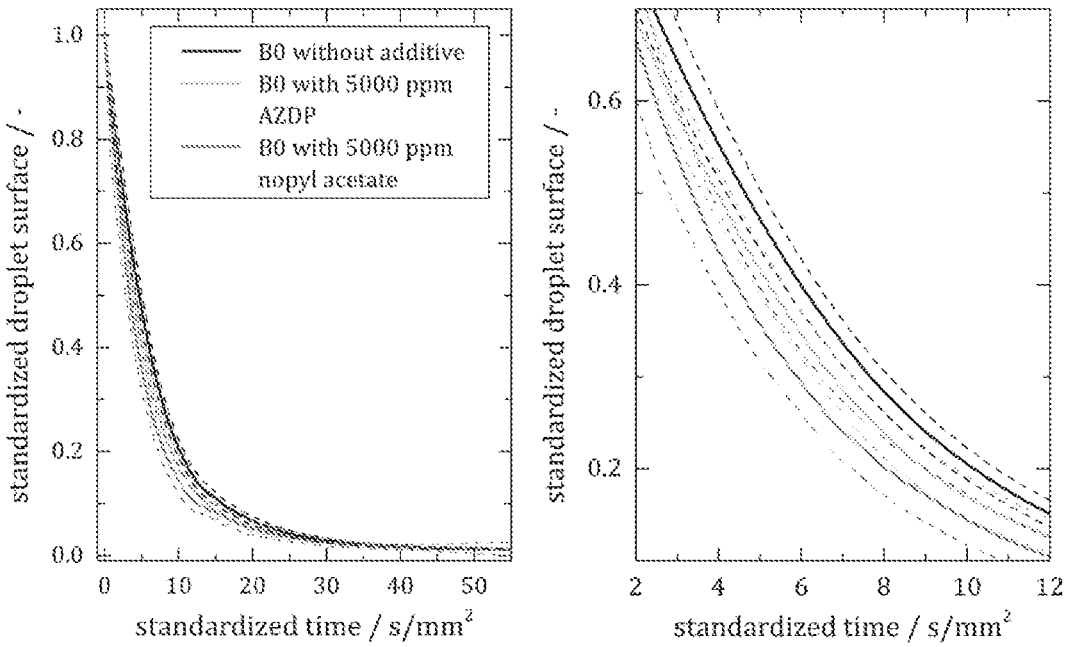
FIG. 4 illustrates the increase in evaporation rate of the diesel fuel when nopyl acetate is added at a treat rate of 5000 ppmw and compares it to the increase in evaporation rate obtained with the addition of AZDP at the same treat rate.

FIG. 4 shows that the evaporation rate of the diesel fuel is greater on addition of nopyl acetate compared to the evaporation rate which is obtained by using AZDP as blowing agent.

In summary, the results in Table 2 and FIGS. 1, 2, 3 and 4 shows that amyl salicylate, diethyl oxalate, linalyl acetate and nopyl acetate have a higher impact than AZDP on the evaporation rate of diesel base fuel.

That which is claimed is:

1. A method for increasing evaporation rate of a diesel fuel composition in an internal combustion engine which method comprises adding to the diesel fuel composition an amount of a blowing agent, wherein the blowing agent is nopyl acetate, wherein the blowing agent is present in the diesel fuel composition at a level in the range from 0.001 wt % to 5 wt %, by weight of the diesel fuel composition, and wherein the diesel fuel composition comprises at least 50% wt of diesel base fuel and wherein the increase in evaporation rate is measured by acoustic levitation.

2. The method for increasing evaporation rate of a diesel fuel composition in an internal combustion engine according to claim 1 wherein the blowing agent is present in the diesel fuel composition at a level in the range from 0.001 wt % to 0.5 wt %, by weight of the diesel fuel composition.

3. The method for increasing for increasing evaporation rate of a diesel fuel composition in an internal combustion engine according to claim 1 wherein the diesel fuel composition comprises a solvent for enhancing the miscibility of the blowing agent.

4. The method for increasing evaporation rate of a diesel fuel composition in an internal combustion engine according to claim 3 wherein the solvent is an alcohol having 1 to 20 carbon atoms.

5. The method for increasing evaporation rate of a diesel fuel composition in an internal combustion engine according to claim 1 wherein the diesel fuel composition comprises at least 75 wt % of diesel base fuel.

6. The method for increasing evaporation rate of a diesel fuel composition in an internal combustion engine according to claim 5 wherein the diesel base fuel comprises liquid hydrocarbon middle distillate gas oil(s).

7. The method for increasing evaporation rate of a diesel fuel composition in an internal combustion engine according to claim 6 wherein the diesel base fuel has a boiling point in the range of 150 to 400° C.

8. The method for increasing evaporation rate of a diesel fuel composition in an internal combustion engine according to claim 6 wherein the diesel base fuel has a density from 750 to 900 kg/m$^3$ and a cetane number from 35 to 80.

9. The method for increasing evaporation rate of a diesel fuel composition in an internal combustion engine according to claim 1 wherein the diesel fuel composition comprises a Fischer-Tropsch derived base fuel.

10. Diesel fuel composition comprising a diesel base fuel and at least one blowing agent wherein the blowing agent is nopyl acetate.

11. Diesel fuel composition according to claim 10 wherein the blowing agent is present in the diesel fuel composition at a level in the range from 0.001 wt % to 5 wt %, by weight of the diesel fuel composition.

* * * * *